United States Patent [19]

Lukyanov et al.

[11] 4,055,722

[45] Oct. 25, 1977

[54] ELECTRODE HOLDER

[76] Inventors: Jury Sergeevich Lukyanov, ulitsa Bljukhera, 35, kv. 51; Lev Seliverstovich Kazantsev, ulitsa Rimskogo-Korsakova, 11, kv. 69; Andrei Grigorievich Pomeschikov, ulitsa Rimskogo-Korsakova, 10, kv. 2; Gennady Fedorovich Skvortsov, prospekt Karla Marxa, 25, kv. 26, all of Novosibirsk, U.S.S.R.

[21] Appl. No.: 665,933

[22] Filed: Mar. 11, 1976

[51] Int. Cl.[2] ..... H05B 7/102; H05B 7/103

[52] U.S. Cl. ..... 13/16

[58] Field of Search ..... 13/9, 14–18

[56] References Cited

U.S. PATENT DOCUMENTS

| | | | |
|---|---|---|---|
| 1,028,150 | 6/1912 | Taylor | 13/16 UX |
| 1,076,054 | 10/1913 | Orr | 13/16 UX |
| 2,700,692 | 1/1955 | Carleton, Jr. | 13/16 |
| 3,781,935 | 1/1974 | Medovar et al. | 13/14 X |

*Primary Examiner*—R. N. Envall, Jr.

*Attorney, Agent, or Firm*—Lackenbach, Lilling & Siegel

[57] ABSTRACT

An electrode holder comprises a casing of the electrode holder comprises, a cantilever head with recesses to install electrodes therein; on one of the walls of said cantilever head there are secured electroconducting contact plates with current-feeding pipes provided with replaceable inserts from electroconducting material, the thickness of the inserts employed depends on the thickness of the electrode to be installed; and each said replaceable insert has a cooling cavity, connected, via pipes for delivery and discharge of a cooling agent to a corresponding cavity for cooling said contact plate and said current-feeding pipe.

3 Claims, 6 Drawing Figures

ELECTRODE HOLDER

Figure 1:
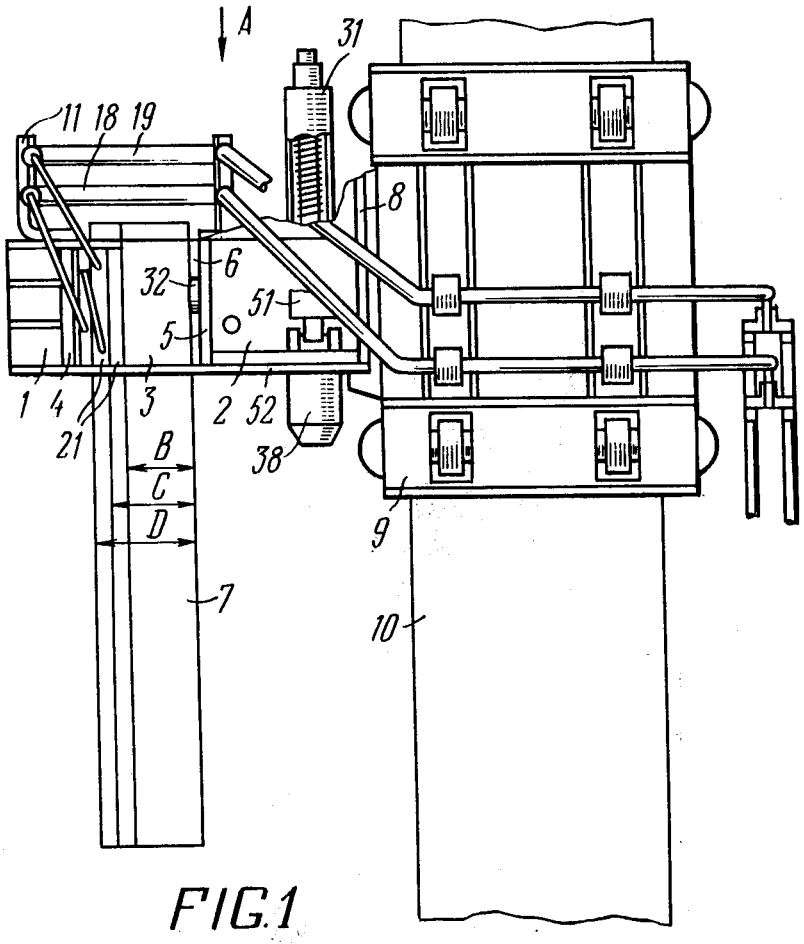

The present invention relates to electrometallurgical equipment and, more specifically, to electrode holders.

The invention can be used for clamping and retaining consumable electrodes when they melt in electroslag furnaces, and also can be used for clamping and retaining permanent electrodes in other units, for instance, in flux-melting furnaces.

Widely known in the art are electrode holders of arc, electroslag and flux-melting furnaces of various designs, comprising a cantilever head to which a contact plate is secured via an electro-insulating gasket. Said contact plate is provided with current-feeding pipes and a mechanism for clamping the electrode to the contact plate and retaining said electrode in operation (said mechanism can be of any one of numerous types, such as spring-hydraulic, spring-pneumatic, clip and of other like type).

The main shortcoming of these designs of the electrode holders is that they comprise a cantilever head which allows clamping and retaining only one electrode of a certain type, size or section.

For clamping an electrode of a different section, it is necessary to have another electrode holder or an inventory head which is welded or screwed to the electrode. In case of necessity of simultaneous fixing of two electrodes a second electrode holder of the same type is required.

Welding of said inventory heads to electrodes is a labor-consuming operation, which requires special and complicated welding equipment. Outfitting of a furnace, for example, of an electroslag one, with two similar electrode holders simultaneously increases its weight and size, and makes its structure bulky, complicated, inconvenient and unreliable in operation.

Also known in the art are electrode holders; for example, of electroslag furnaces which are made in the form of a casing from stainless steel, which casing comprises a cantilever head with one or two recesses for installing electrodes.

Secured on one of the walls of said recesses are contact plates with current-feeding pipes.

The casing of the electrode holder has mounted thereon mechanisms for clamping the electrodes which number is the same, as the number of electrodes to be installed. Each said mechanism represents itself a pipe with compression springs inserted thereinto, the pipe is displaced in guides. The pipe is connected, via clamping levers, to a rod of a hydraulic cylinder and the electrode to be clamped. When the pipe moves upwards, under the action of the force of said pre-compressed springs, clamping of the electrode is effected (by said clamping lever). Unclamping of the electrode is effected by said hydraulic cylinder which, via said rod and a corresponding lever, displaces the pipe downwards, compressing a set of said springs. The pipe, being displaced downwards, turns the clamping lever which clamps the electrode around the fixing fulcrum and draws said lever aside from said electrode.

The designs of such electrode holders are more compact and make it possible to clamp simultaneously one or two electrodes of a certain section (thickness).

The main shortcoming of the design of these electrode holders is that for melting of electrodes of different sections it is necessary to weld inventory heads to them, that is connected, as it has been mentioned above, with a time-taking operation and the need to have complicated welding equipment.

The object of the present invention is to eliminate the above-mentioned shortcomings.

The invention is based on the task of creating a compact and simple electrode holder which allows clamping and retaining of electrodes of different (any) thickness thanks to utilization in the design of replaceable inserts which are easily mounted and dismantled on contact plates in the process of operation.

The invention is achieved in an electrode holder, for instance, for an electroslag furnace, comprising a cantilever head with recesses to install electrodes therein; on one of the walls thereof there are secured electroconducting contact plates with current-feeding pipes, according to the invention, said contact plates are provided with replaceable inserts from electroconducting material the thickness of which is chosen depending on the thickness of the electrode to be installed; in such a case, each said replaceable insert has a cooling cavity connected, via pipes for delivery and discharge of a cooling agent, with a corresponding cavity of said contact plate and current-feeding pipe.

The herein-proposed electrode holder is more simple and compact, universal and economical in operation. The electrode holder permits installing and melting electrodes of different sections without welding inventory heads to them, which makes the output considerably cheaper, as the time-taking process in preparing the electrodes is sharply reduced.

In the same way the necessity to outfit the furnace with several types of the size of electrode holders for certain sections of electrodes no longer arises.

The electrode holer is handy in operation, as for changing said replaceable inserts there is no need in dismantling or assembling any other units of the electrode holder. Due to the use of the same pipes for th delivery and discharge of a cooling agent to said replaceable inserts and to fixing of the replaceable inserts with the help of easily-removable bolts, less time is required for re-setting up of the electrode holder for work with electrodes of a different section.

It is expedient that holes for connecting the pipes for the delivery and discharge of the cooling agent be arranged in said replaceable inserts along the radius of the turn of the pipes relative to corresponding axes of their fastening to said contact plate and said current-feeding pipe, in this case, the radius of the turn of each said pipe should be equal to its length.

Such arrangement of said holes in the replaceable inserts allows the use of the same pipes for the delivery and discharge of the cooling agent to various replaceable inserts, which diminishes the number of replaceable parts of the electrode holder, lessens its weight and simplifies its re-setting up.

It is preferable that joint for the holes in said replaceable inserts for connecting the pipes for the delivery and discharge of the cooling agent be made threaded, as in this case assembly and dismantling of the replaceable inserts is simpler and require less time.

It is expedient that the fixing of the pipes for the delivery and discharge of the cooling agent to said contact plates and said replaceable inserts be made as hinged, which ensures their turn around the fixing axis in changing said replaceable inserts and compensates for any manufacturing tolerances and assembly of conjugated elements.

Figure 2:
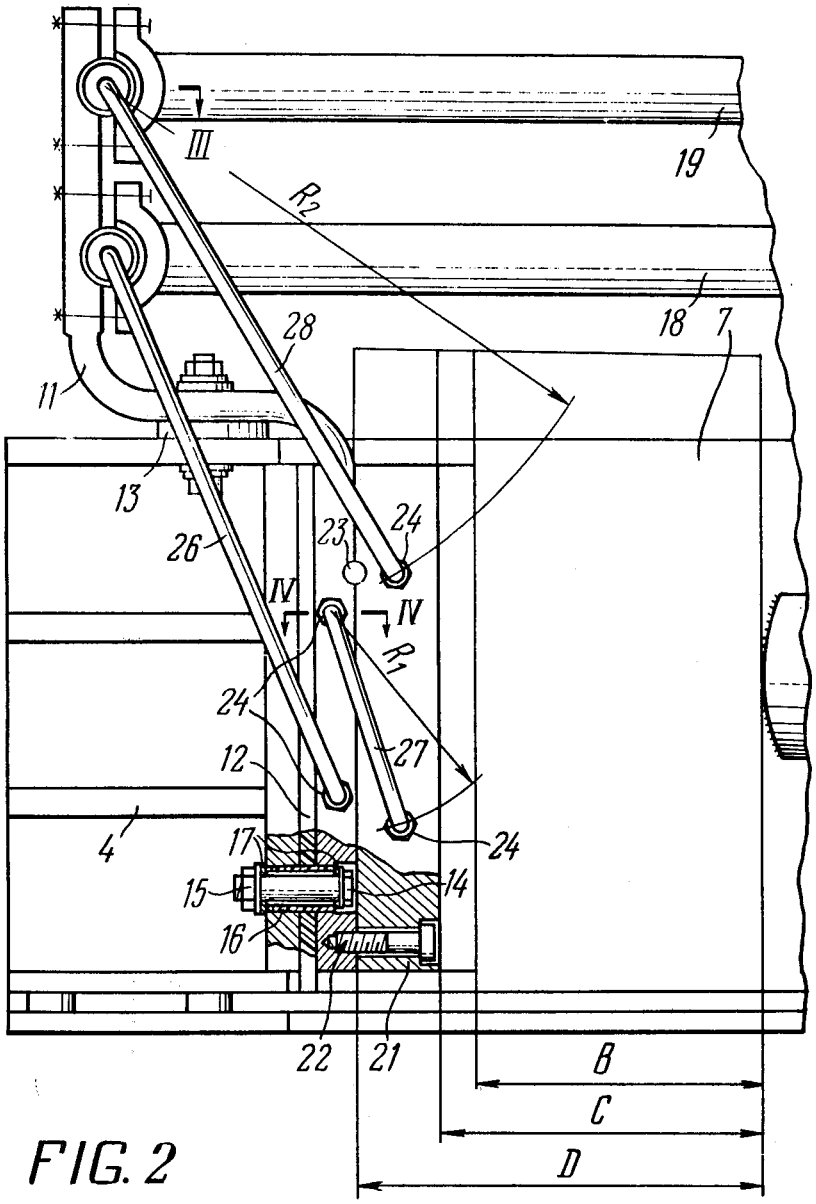
Figure 3:
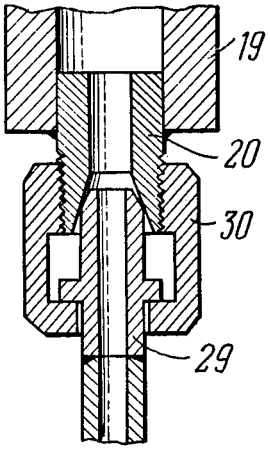
Figure 4:
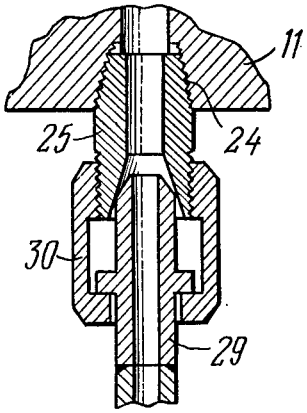
Figure 5:
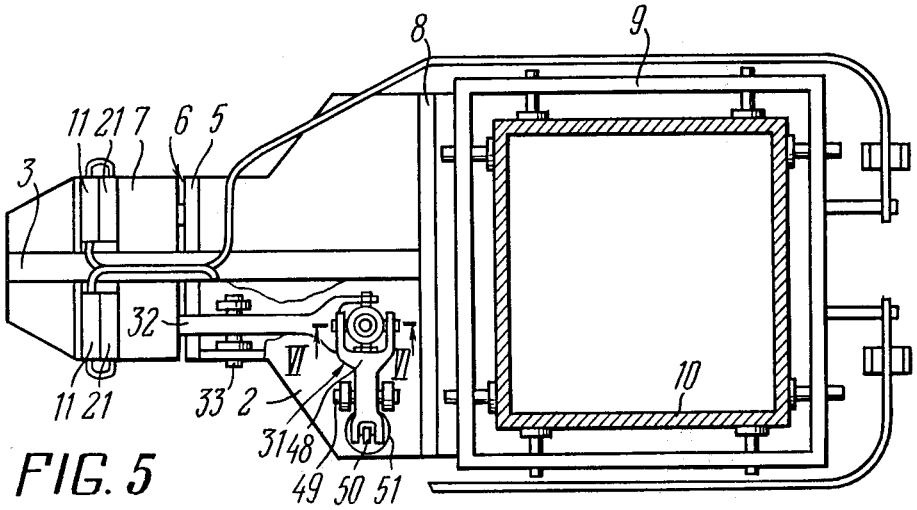
Figure 6:
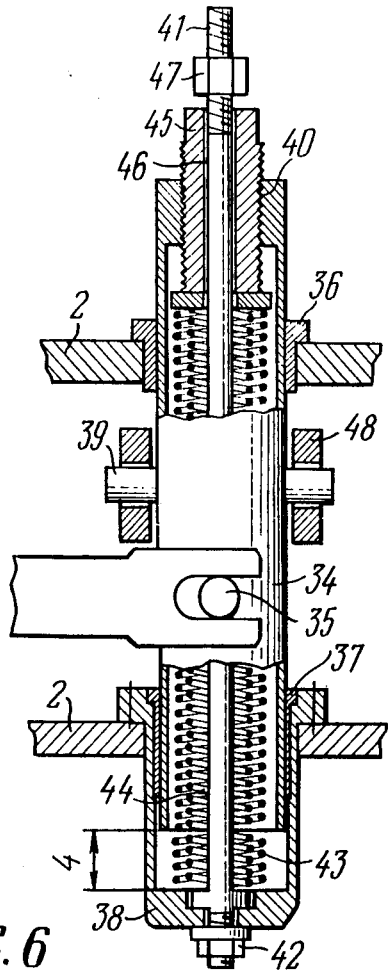

The nature of the invention will be clear from the following detailed description of particular embodiments thereof, to be had in conjunction with the accompanying drawings, in which:

FIG. 1 schematically shows a general view of the electrode holder, for example, for an electroslag furnace, in which said contact plates are provided with replaceable inserts made from electroconducting material, according to the invention;

FIG. 2 shows an enlarged scale connection of said pipes for the delivery and discharge of the cooling agent to said replaceable inserts in FIG. 1;

FIG. 3 - is a sectional view along the line III—III of FIG. 2 drawn on an enlarged scale;

FIG. 4 - is a sectional view along the line IV—IV of FIG. 2 drawn on an enlarged scale;

FIG. 5 - is a plan view looking in the direction of arrow A in FIG. 1 drawn on an enlarged scale; and FIG. 6 is a sectional view along the line VI—VI of FIG. 5.

The electrode holder, for example, for an electroslag furnace (FIG. 1), according to the invention, comprises a cantilever head 1 of a welded structure, connected to a casing 2 of the electrode holder. Said cantilever head 1 represents by itself a quarter beam 3 made, for instance, from sheet steel.

Two support arms 4 are welded on one end of the beam 3, and two ribs 5 are welded in the middle portion of said beam, perpendicular to it; the other end of the beam 3 is passed through in the casing 2 of the electrode holder. Said cantilever head 1, with the help of the beam 3 and the ribs 5, is rigidly connected to the casing 2 of the electrode holder. Between the arms 4 and the ribs 5 there are provided recesses 6 to install electrodes 7 therein.

The casing 2 of the electrode holder is made as a welded structure with stiffening ribs and platforms for placing and fixing parts of the electrode holder. Said casing 2 comprises a flange 8 for fastening the electrode holder to a carriage 9 which is arranged on a vertical column 10 of the electroslag furnace.

The recesses 6 also house contact plates 11 (FIG. 2) which plates, through insulating gaskets 12 and 13, are secured to the arms 4 by means of bolts 14 and nuts 15. Said bolts 14 and said nuts 15 are also isolated from the arms 4 by means of insulating bushings 16 and washers 17.

The contact plates 11 are made of copper or bronze and each has a water-cooled cavity.

Current-feeding pipes 18 and 19 made of copper are fastened to said contact plates 11 by means of bolts.

Pipe connections 20 (FIG. 3) having conic holes are welded on the ends of the current-feeding pipes 18 and 19.

To make it possible to install the electrodes 7 of a different thickness (B, C, D, etc.) in the electrode holder there are provided replaceable inserts 21 (FIGS. 1,2) which are secured to the contact plates 11 with the help of bolts 22 and fixing pins 23.

The replaceable inserts 21 are also made of copper or bronze and comprise a water-cooled cavity. The thickness of the replaceable inserts 21 is chosen depending on the thickness of the electrodes 7 to be installed.

The replaceable inserts 21 and the contact plates 11 each comprise two conic threaded holes 24 (FIGS. 2,4) which are connected to the corresponding water-cooled cavities. Pipe connections 25 (FIG. 4) having conic holes are screwed into the threaded holes 24. For the delivery and discharge of the cooling water to the contact plates 11 (FIG. 2) and the replaceable inserts 21 there are provided pipes 26, 27 and 28 with nipples 29 (FIGS. 3,4) welded on the ends of said pipes 26, 27 and 28. The nipples 29 have a semi-spherical surface. With the help of coupling nuts 30 the pipes 26, 27 and 28 are conjugated with the corresponding pipe connections 20 and 25 of the current-feeding pipes 19 and 18, the contact plates 11 and the replaceable inserts 21, i.e., their water-cooled cavities are communicated with each other in succession via the pipes 26, 27 and 28.

To clamp said electrodes 7 (FIGS. 1 and 5) on the casing 2 there are arranged two spring-lever mechanisms 31.

Each of said spring-lever mechanisms 31 has a double-arm clamping lever 32 mounted, via a hinge, on an axle 33 (FIG. 5) which is secured on the casing 2 (FIG. 1). By the end of its short arm the clamping lever 32 (FIG. 5) rests against the electrode 7, and by the end of its long arm, made in the form of a fork, said lever 32 is conjugated with a pipe 34 (FIG. 6), through journals 35 positioned on its dimetrically opposite sides.

The pipe 34 is mounted vertically and may be made or displaced with respect ot guides 36 and 37. The guide 36 is rigidly secured on the casing 2, and the guide 37 — in a supporting shell 38 which is also rigidly secured on the casing 2. On the pipe 34, at an angle of 90° to the axis of the journals 35; there are journals 39. Also there is a threaded hole 40 on the top end of said pipe 34.

A bar 41 is coaxially arranged inside the pipe 34, the bar is fastened to the supporting shell 38 by means of a nut 42.

Several pairs of big and small (according to their diameter) compression springs are put on the bar 41, said springs are of the same length (height); in this case, small compression springs 44 are arranged inside big compression springs 43. Said compression springs 43 and 44 rest onto the supporting shell 38.

For a preliminary (working) clamping of the compression springs 43 and 44 a bolt 45 is screwed into the threaded hole 40 of the pipe 34; along the axis of said bolt is a through hole 46 for passage of the bar 41.

A nut 47 is screwed on the top threaded end of said bar 41, and said nut restricts the displacement of the pipe 34 upwards under the action of the force of the springs 43 and 44.

The pipe 34 is conjugated, via the journals 39, with a double- arm lever 48 which is mounted, via a hinge, on an axle 49 secured on the casing 2. The free end of the lever 48 is hinged with the end of a rod 50 of a hydraulic cylinder 51 (FIG. 1) which is also secured, via a hinge, on the casing 2.

The electrode holder is provided from below with a heat-insulating screen 52 for protecting its elements from direct emission.

The electrode holder assembled for installing necessary electrodes, functions as follows.

When a liquid is fed into a piston cavity of the hydraulic cylinder 51 (FIG. 5) the end of the lever 48 which end is hinged with the rod 50, is being displaced upwards. At this moment the other end of the lever 48, conjugated with the pipe 34 (FIG. 6), through the journals 39, moves downwards together with the pipe 34 which compresses, via the bolt 45, the big and small compression springs 43 and 44 to the value of their summary movement (remaining after the preliminary compression of the springs).

In this case, the end of the clamping lever 32 (FIG. 5), conjugated with the pipe 34, through the journals 35, also goes downwards, while its other end which faces the electrode 7 and which comes into the recess 6, through a hole provided in the rib 5, is being displaced upwards, i.e., the clamping lever 32, turning on the axle 33, moves off from its initial position and frees the recess 6 for inserting and installing the electrode 7.

The electrode 7 is inserted into the recess 6 of the cantilever head 1. Then the piston cavity of the hydraulic cylinder 51 is decompressed, and the pipe 34, under the action of the force of the springs 43 and 44, moves upwards. At the same time the end of the clamping lever 32 also moves upwards, which means that its other end, which faces the electrode 7, goes downwards, rests against the electrode 7 and reliably clamps it to the replaceable insert 21 (or to the contact plate 11 if the electrode holder operates without the replaceable inserts).

Thus, the unclamping of the electrodes 7 is accomplished by the hydraulic cylinders 51, and their clamping is accomplished through the force of the compression springs 43 and 44.

To change said replaceable inserts 21 it is necessary to disconnect only the pipes 27 and 28 (FIG. 2) and to unscrew the bolts 22. After other said replaceable inserts 21 are mounted, the pipes 27 and 28 are conjugated with corresponding holes of said replaceable inserts 21, arranged along the radius $R_1$ and $R_2$ of the corresponding pipes of rotation relative to their axis of fastening to the current-feeding pipe 19 and the contact plate 11.

What we claim is:

1. An electrode holder for holding electrodes of different types and sizes comprising: a casing for the electrode holder; a cantilever head having recesses and said head is connected to said casing; at least one electrode adapted to be installed in said recesses of said contilever head; electroconducting contact plates with current-feeding pipes secured on one of the walls of said cantilever head; said contact plates are provided with replaceable inserts made from electroconducting material, the thickness thereof depending on the thickness of said electrode to be installed; and each of said replaceable inserts having a cooling cavity communicating through said pipes for the delivery and discharge of a cooling fluid, with a corresponding cooling cavity of said contact plate and said current-feeding pipe.

2. An electrode holder according to claim 1, wherein holes for the connection of said pipes for the delivery and discharge of said cooling fluid are arranged along the radius of rotation of said pipes relative to corresponding fulcrums of fastening same to said contact plate in case of delivery and to the current-feeding pipe in case of discharge of the cooling fluid, and the radius of the rotation of the pipe being equal correspondingly to its length.

3. An electrode holder according to claim 1, wherein the joint for the holes in said replaceable inserts, for connection of the pipes for the delivery and discharge of the cooling fluid forms a threaded one, while the connection or fastening of the pipes for the delivery and discharge of the cooling fluid forms a hinged one.

* * * * *